US008852681B2

(12) United States Patent
Jakimov et al.

(10) Patent No.: US 8,852,681 B2
(45) Date of Patent: Oct. 7, 2014

(54) MASK FOR KINETIC COLD GAS COMPACTING

(75) Inventors: Andreas Jakimov, Munich (DE); Manuel Hertter, Munich (DE); Stefan Schneiderbanger, Bergkirchen (DE)

(73) Assignee: MTU Aero Engines GmbH, Munich (DE)

( * ) Notice: Subject to any disclaimer, the term of this patent is extended or adjusted under 35 U.S.C. 154(b) by 283 days.

(21) Appl. No.: 13/128,383

(22) PCT Filed: Nov. 7, 2009

(86) PCT No.: PCT/DE2009/001578

§ 371 (c)(1),
(2), (4) Date: May 9, 2011

(87) PCT Pub. No.: WO2010/051804

PCT Pub. Date: May 14, 2010

(65) Prior Publication Data

US 2011/0223325 A1 Sep. 15, 2011

(30) Foreign Application Priority Data

Nov. 10, 2008 (DE) ..... 10 2008 056 652

(51) Int. Cl.

| | |
|---|---|
| ***B05D 1/12*** | (2006.01) |
| ***B05D 1/32*** | (2006.01) |
| ***B05B 15/04*** | (2006.01) |
| ***C23C 24/04*** | (2006.01) |

(52) U.S. Cl.

CPC ..... *B05B 15/045* (2013.01); *C23C 24/04* (2013.01)

USPC ..... 427/197; 427/189; 427/282

(58) Field of Classification Search

USPC ..... 427/189, 197, 282

See application file for complete search history.

(56) References Cited

U.S. PATENT DOCUMENTS

| | | | | |
|---|---|---|---|---|
| 5,203,944 | A | 4/1993 | Prinz et al. | |
| 5,302,414 | A | 4/1994 | Alkhimov et al. | |
| 5,573,814 | A | 11/1996 | Donovan | |
| 5,691,018 | A | 11/1997 | Kelley et al. | |
| 6,060,117 | A | 5/2000 | Pergande et al. | |
| 6,592,948 | B1 | 7/2003 | Fusaro, Jr. et al. | |
| 6,645,299 | B2 | 11/2003 | Brown | |
| 7,070,472 | B2 * | 7/2006 | Dean et al. | 445/24 |
| 2004/0047992 | A1 * | 3/2004 | Donelon | 427/282 |

(Continued)

FOREIGN PATENT DOCUMENTS

| | | |
|---|---|---|
| DE | 10 2005 054 393 A1 | 6/2006 |
| DE | 10 2004 058 705 B3 | 8/2006 |

(Continued)

OTHER PUBLICATIONS

German Search Report, dated Mar. 19, 2009, 5 pages.

(Continued)

*Primary Examiner* — Frederick Parker
(74) *Attorney, Agent, or Firm* — Crowell & Moring LLP

(57) ABSTRACT

A mask and method for kinetic cold gas compacting is disclosed. The mask includes a body for covering a not-to-be-coated region of a substrate to be coated having a work side exposed to a coating substance. The work side has a hardness such that the work side is not plastic deformable by a striking coating particle.

2 Claims, 1 Drawing Sheet

(56) References Cited

U.S. PATENT DOCUMENTS

| | | | | |
|---|---|---|---|---|
| 2006/0105113 | A1 | 5/2006 | Endicott et al. | |
| 2006/0251823 | A1 * | 11/2006 | Van Steenkiste et al. | 427/446 |
| 2006/0266434 | A1 | 11/2006 | Beck et al. | |
| 2007/0241164 | A1 | 10/2007 | Barnes et al. | |

FOREIGN PATENT DOCUMENTS

| | | | |
|---|---|---|---|
| DE | 10 2005 044 991 | A1 | 3/2007 |
| DE | 10 2006 029 070 | B3 | 8/2007 |
| DE | 10 2006 037 532 | A1 | 2/2008 |
| DE | 10 2008 011 242 | A1 | 8/2009 |
| DE | 10 2008 025 510 | A1 | 12/2009 |
| EP | 0 776 704 | B1 | 6/1997 |
| JP | 01242955 | A | 9/1989 |
| JP | 07166318 | A | 6/1995 |
| WO | WO 2008/144357 | A1 | 11/2008 |
| WO | WO 2009/143817 | A1 | 12/2009 |

OTHER PUBLICATIONS

PCT/DE2009/001578 PCT/ISA/210.

* cited by examiner

MASK FOR KINETIC COLD GAS COMPACTING

BACKGROUND AND SUMMARY OF THE INVENTION

This application claims the priority of International Application No. PCT/DE2009/001578, filed Nov. 7, 2009, and German Patent Document No. 10 2008 056 652.7, filed Nov. 10, 2008, the disclosures of which are expressly incorporated by reference herein.

The present invention relates to a mask for kinetic cold gas compacting comprising a body for covering a not-to-be-coated region of a substrate to be coated having a work side exposed to the coating substance as well as a method for kinetic cold gas compacting in which a corresponding mask is used.

Kinetic cold gas compacting or kinetic cold gas spraying is known from the prior art for coating materials and in particular also components of gas turbines or aircraft turbines. Kinetic cold gas compacting is described in U.S. Pat. No. 5,302,414 for example. The method is characterized in that coating material in the form of a powder is moved onto the to-be-coated substrate by means of a carrier gas at high speed, but at temperatures below the melting point of the coating substance, wherein when the coating particles strike, the particles, just like the surface region of the to-be-coated substrate, deform due to the high speed so that the materials coalesce and the coating material adheres to the substrate.

Correspondingly, conventional coverings, such as adhesive tape coverings or silicone masking like those used in thermal spraying for example, are not adequate, because they are not able to bear up against the high particle speed.

On the other hand, stable materials, such as metal or plastic for example, are themselves coated so that a solidly adhering coating is produced on the mask making it necessary for these masks to be removed.

This problem was addressed in German Patent Application DE 10 2008 025510.6. The solution proposed there provides for the covering device to be provided with a structured surface, wherein the surface of the mask is configured such that the surface encloses an acute angle with the impact direction of the particles so that the impacting particles do not adhere to the mask, but are merely deflected.

Although this solution is already supplying good results, there is a further need for alternative solutions for corresponding masks for kinetic cold gas compacting which are potentially simpler to manufacture.

The object of the present invention is therefore making available a mask for kinetic cold gas compacting and/or a corresponding method for kinetic cold gas compacting, in which the problems of the prior art are overcome and in particular multiple-use masks are made available, which make possible both simple manufacturing as well as simple use.

The present invention starts with the knowledge that adhesion of the coating substance, i.e., of the particles striking the to-be-coated substrate in an unmelted state at a high speed, on the mask only takes place if the adhesion mechanism on which kinetic cold gas compacting is based is able to occur. This requires that both the impacting particles as well as the surface be deformed plastically in order to guarantee mutual coalescing of the materials and therefore adhesion of the materials. Correspondingly, the invention starts here and proposes a mask, which is configured to be hard on the side facing the coating source, i.e., the work side, in such a way that no surface deformation, i.e., no plastic deformation of the work side, is able to take place during the kinetic cold gas compacting that is used. This prevents the surface material of the mask and the impacting coating particles from deforming and coalescing and thus forming an adhering layer.

Because only the corresponding work side of the mask must have the required hardness, the mask may either be configured such that there is a hard coating on the work side or a correspondingly formed edge region or that the mask as a whole is configured with a corresponding hardness, wherein the mask may then be configured homogenously over the thickness.

To achieve a sufficient hardness on the work side a case-hardened or nitride-hardened steel or a corresponding hard material may be provided.

In particular, the mask may be case-hardened or nitride-hardened on the work side. If the mask is not through-hardened, there would then be a steel in the region of the base body suitable for case hardening or nitride hardening, while the surface region of the work side would be correspondingly age-hardened.

The hard material for forming the mask or for forming a hard surface layer on the work side of the mask may be formed of diamond, diamond-like carbon, cubic boron nitride, silicon carbide, aluminum oxide, boron carbide, tungsten carbide, vanadium carbide, titanium carbide, titanium nitride and/or zirconium dioxide or combinations thereof.

In addition, the hard material may also be enriched in a corresponding surface. In particular, $Cr_3C_2$—NiCr, Co28Mo18Cr3,5Si (T800) or the like may be used as a material for the hard work side.

Additional advantages, characteristics and features of the present invention are made clear in the following detailed description of exemplary embodiments on the basis of the enclosed drawings. The drawings in this case show the following in a purely schematic manner:

DETAILED DESCRIPTION OF THE DRAWINGS

Figure 1:
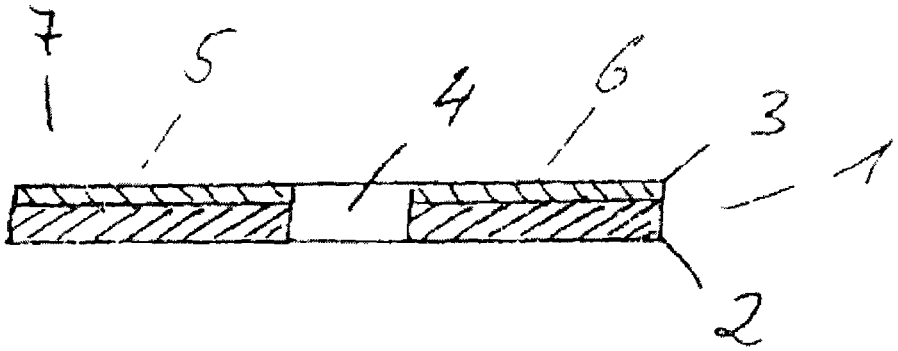
FIG. 1 is a cross-sectional view of a first embodiment of a mask according to the invention mask.

FIG. 1 shows a cross-sectional view of a first embodiment of a mask 1 according to the invention, which has a base body 2, in which a passage opening 4 is provided. The passage opening 4 makes a coating possible in this region of the mask 1, while, in the remaining regions 5 and 6, the to-be-coated substrate arranged under the mask is shielded from the coating material. Corresponding, the side of the mask 1 designated by reference number 7 is the work side, i.e., the side that faces the coating source.

A coating 3 is provided on this work side 7, which is made of a harder material as compared with the base body 2. In particular, the coating 3 is a hard material layer such as a chromium-nickel steel hardened with chromium carbides or other suitable hard material layers.

Instead of a coating 3, which is applied to base body 2, it can also be a modified edge region 3, which has a much harder hardness as compared to the base body 2. In particular, the mask 1 may be made of a case-hardenable or nitride-hardenable steel, wherein the edge region 3 is correspondingly hardened by case hardening or nitride hardening.

It is essential that the work side 7 have a sufficiently high level of hardness in order to prevent the coating particles striking the mask from adhering to the mask 1.

Figure 2:
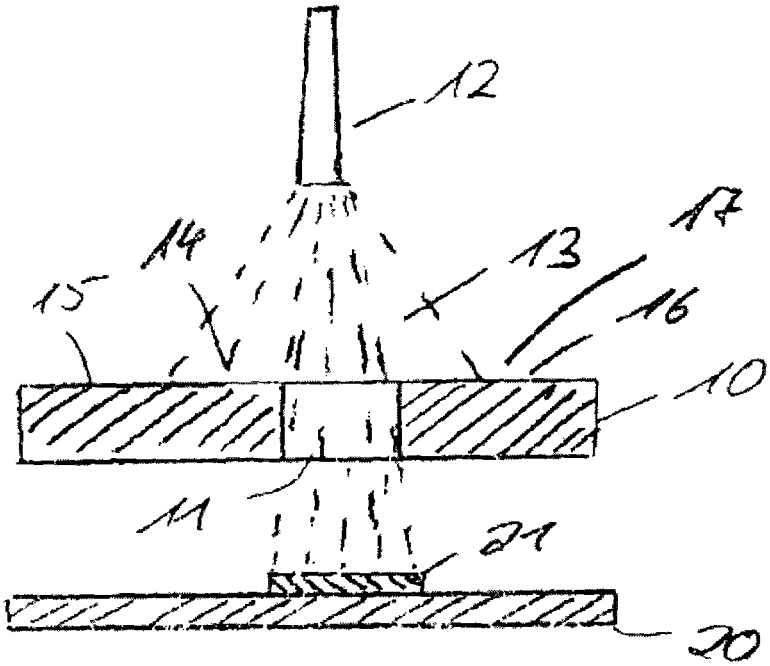
FIG. 2 is a cross-sectional view of a second mask according to the invention in use during kinetic cold gas compacting.

FIG. 2 shows a second embodiment of a mask 10 according to the invention, which is configured to be homogenous, i.e., has the same material over its entire thickness. For example, this can be a through-hardened case-hardened steel or nitriding steel. The mask 10 again features a passage opening 11, which defines the coating region for the substrate 20 that is arranged underneath.

Only in this coating region, which is defined by the passage opening 11, will a surface layer 21 be formed from the coating substance during the coating of the substrate 20.

The coating substance is accelerated in the direction of the substrate 20 by a device (not shown) for kinetic cold gas compacting or kinetic cold gas spraying, wherein merely the nozzle 12 of the corresponding device is depicted. The particle streams 13 are prevented from reaching the substrate 20 by the shading regions 15 and 16 of the mask 10. Because of the hard formation of the mask 10, there is no deformation of the particles on the hard work side 17 in the impact regions 14 of the particle beams 13 and therefore deposition of an adhering layer does not take place.

Although the present invention was described in detail on the basis of exemplary embodiments, it is a matter of course for a person skilled in the art that the invention is not restricted to these exemplary embodiments, rather that modifications or alterations are possible in such a way that individual features are dispensed with or a different combination of features is selected without leaving the protective scope of the enclosed claims. In particular, the present invention includes all combinations of all presented individual features, including those of Application DE 10 2008 025510.6 to which reference was made.

The invention claimed is:

1. A mask for kinetic cold gas compacting, comprising:

a body for covering a not-to-be-coated region of a substrate to be coated with coating particles from a kinetic cold gas compacting device having a work side exposed to the coating particles;

wherein the body or at least the work side is made of a case-hardened or nitride-hardened steel such that the body or the work side is not plastically deformable by coating particles striking the body or the work side from the kinetic cold gas compacting device.

2. A method for kinetic cold gas compacting, comprising the steps of:

covering a component to-be-coated with coating particles from a kinetic cold gas compacting device by a mask which has a work side facing the kinetic cold gas compacting device and which defines an opening therein, wherein the work side has a hardness such that the work side is not plastically deformable by coating particles striking the work side from the kinetic cold gas compacting device and wherein the mask or at least the work side is made of a case-hardened or nitride-hardened steel; and spraying the coating particles from the kinetic cold gas compacting device onto the work side of the mask and not plastically deforming the work side of the mask and the coating particles sprayed onto the mask.

* * * * *